US007950786B2

(12) United States Patent
Cheng et al.

(10) Patent No.: US 7,950,786 B2
(45) Date of Patent: May 31, 2011

(54) INK-JET DEVICE AND METHOD FOR DEPOSITING INK USING THE SAME

(75) Inventors: Chen-Hsing Cheng, Hsinchu (TW); Yu-Ning Wang, Hsinchu (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 888 days.

(21) Appl. No.: 11/923,022

(22) Filed: Oct. 24, 2007

(65) Prior Publication Data

US 2008/0186366 A1 Aug. 7, 2008

(30) Foreign Application Priority Data

Feb. 5, 2007 (TW) ..... 96104035 A

(51) Int. Cl.
*B41J 2/175* (2006.01)
*B41J 2/19* (2006.01)

(52) U.S. Cl. ..... 347/85; 347/92

(58) Field of Classification Search ..... 347/84, 347/85, 92, 94
See application file for complete search history.

(56) References Cited

U.S. PATENT DOCUMENTS 4,628,333 A * 12/1986 Terasawa ..... 347/87
6,000,792 A * 12/1999 Koizumi et al. ..... 347/89
6,007,193 A * 12/1999 Kashimura et al. ..... 347/92

FOREIGN PATENT DOCUMENTS

JP 405096741 * 4/1993 ..... 347/85
JP P2003-94681 A 4/2003
JP 2004025702 * 1/2004

* cited by examiner

*Primary Examiner* — Anh T. N. Vo
(74) *Attorney, Agent, or Firm* — Jeffrey T. Knapp

(57) ABSTRACT

An ink-jet device (20) is provided. The ink-jet device includes an ink reservoir (22), a print head (24), and a carry-in pipe (26) connected between the ink reservoir and the print head. The ink-jet device further includes an air outlet pipe (28) and a balance pipe (30). The air outlet pipe is connected with the print head and intercommunicates with the atmosphere. The balance pipe is connected between the carry-in pipe and the air outlet pipe. A method for eliminating air bubbles in print head is also provided.

8 Claims, 5 Drawing Sheets

INK-JET DEVICE AND METHOD FOR DEPOSITING INK USING THE SAME

BACKGROUND

1. Field of the Invention

The present invention generally relates to an ink-jet device and, particularly, to an ink-jet device and a related method for depositing ink using the same.

2. Description of Related Art

A liquid crystal display typically utilizes a color filter to display images and graphs. The color filter is constructed by arranging the colored portions, which are colored in red (R), green (G), and blue (B), as three primary colors of light on a transparent substrate. A dyeing method, a pigment dispersing method, an electrodepositing method, and the like have generally been as among the available manufacturing options for making the color filter. Recently, an ink jet system, simple in process and economically advantageous, has been used.

Referring to FIG. 5, an ink-jet device 10 generally includes an ink reservoir 12 and at least one print head 14. The level of the ink reservoir 12 is commonly higher than that of the print head 14, in order to promote gravity-induced flow. A carry-in pipe 16 is connected between the ink reservoir 12 and the print head 14. Ink channel ends 140, opposite the nozzles 142, are in communication with the carry-in pipe 16, to which an external ink supply (e.g., the ink reservoir 12) is connected. A plurality of nozzles 142 extends out of a bottom surface of the print head 14. In operation, ink supplied by the ink reservoir 12 flows into the ink channel 140 through the carry-in pipe 16 and then flows out from the nozzles 142. For various reasons, during the process mentioned above, a significant number of air bubbles may potentially be mixed and/or trapped into the ink. During the process of the ink flowing out from the nozzles 142, if the forming ink droplets come in contact with the air bubbles, the contact is likely to lead to deformation of the ink droplets. As a result, a resulting pattern formed on a substrate under the print head 14 tends to be non-uniform.

The conventional method for eliminating air bubbles in the print head is to supply a great deal of ink into the ink channels or turn the print head upside-down. Such options always require extra time and cost.

What is needed, therefore, is an ink-jet device and accompanying method for depositing ink using the ink-jet device, in order to overcome the above-described shortcomings.

SUMMARY OF THE INVENTION

An ink-jet device essentially includes an ink reservoir, a print head, and a carry-in pipe connected between the ink reservoir and the print head. The ink-jet device further includes an air outlet pipe and a balance pipe. The air outlet pipe is connected with the print head and intercommunicates with the atmosphere. The balance pipe is connected between the carry-in pipe and the air outlet pipe.

A method for depositing ink using an ink-jet device, the ink-jet device having a print head, the method being performed in a manner so as to promote elimination of air bubbles in the print head, the method comprising the steps of: providing an ink-jet device comprising an ink reservoir, a print head with a plurality of nozzles extending out thereof, a carry-in pipe connected between the ink reservoir and the print head, an air outlet pipe connected with the print head and intercommunicating with the atmosphere, the air outlet pipe comprising an air outlet valve, and a balance pipe connected between the carry-in pipe and the air outlet pipe, the balance pipe comprising a one-way valve configured for preventing the ink in the carry-in pipe from flowing into the air outlet pipe; closing the one-way valve and the nozzles, and opening the air outlet valve; forcing the ink reservoir to eject an amount of the ink out therefrom so as to form a pressure balance between the carry-in pipe and the air outlet pipe; opening the one-way valve to break/reduce the pressure balance before opening the one-way valve; and closing the air-outlet valve and opening the nozzles to force the ink to be jetted out from the nozzles.

BRIEF DESCRIPTION OF THE DRAWING

Many aspects of the present device and method can be better understood with reference to the following drawings. The components in the drawings are not necessarily drawn to scale, the emphasis instead being placed upon clearly illustrating the principles of the present device and method. Moreover, in the drawings, like reference numerals designate corresponding parts.

DETAILED DESCRIPTION OF THE INVENTION

Reference will now be made to the drawings to describe, in detail, the present embodiment of the device and the method.

Figure 1:
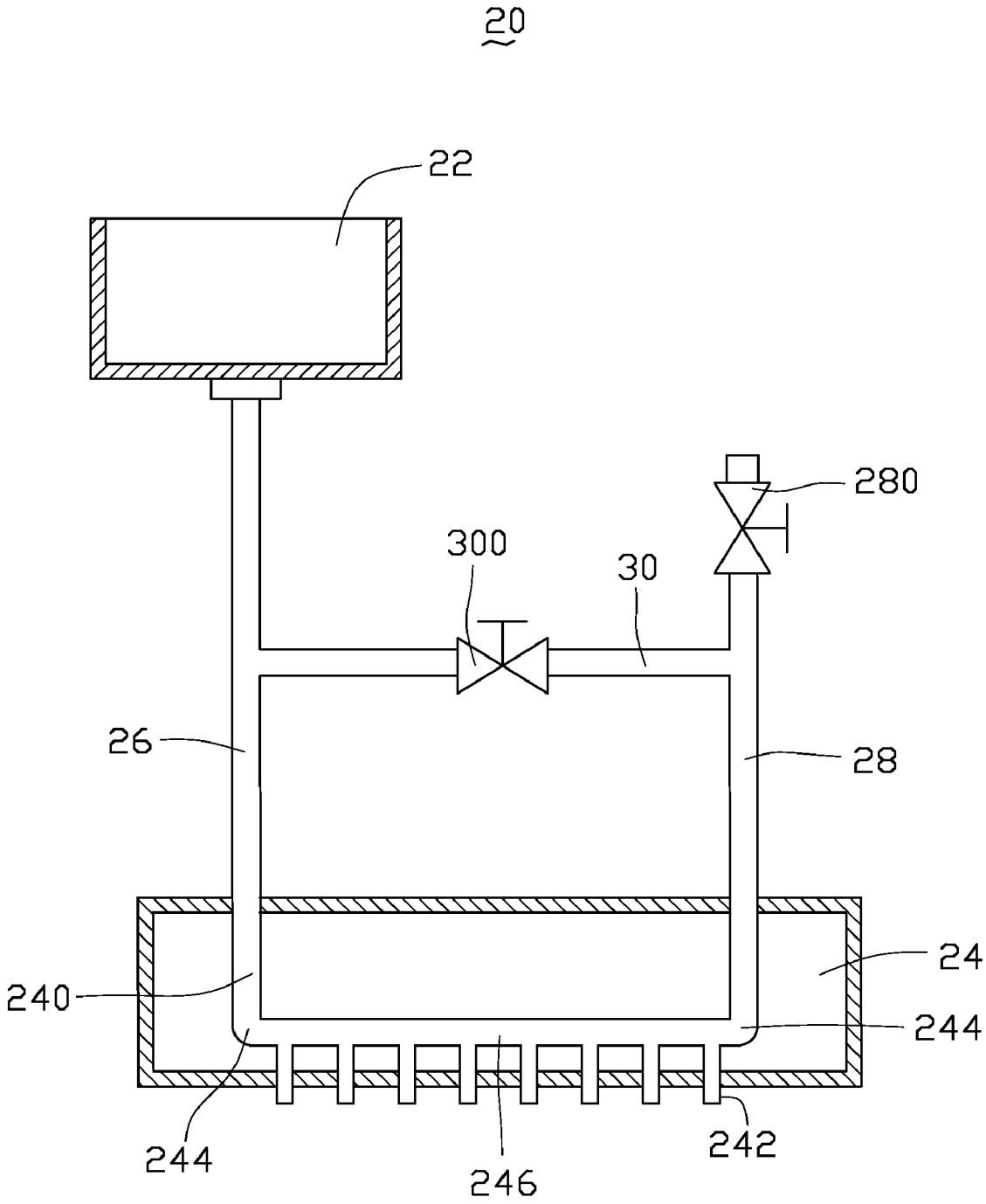
FIG. 1 is a cross-sectional view of an ink-jet device, in accordance with the first present embodiment.

Referring to FIG. 1, an ink-jet device 20, according to a first present embodiment, includes an ink reservoir 22 and a print head 24. A carry-in pipe 26 is connected between the ink reservoir 22 and the print head 24. The ink-jet device 20 further includes at least one air outlet pipe 28 and at least one balance pipe 30. The air outlet pipe 28 is configured for connecting the print head 24 and atmosphere. The balance pipe 30 is fluidly connected between the carry-in pipe 26 and the air outlet pipe 28 and is configured for facilitating a pressure balance between the carry-in pipe 26 and the air outlet pipe 28. The air outlet pipe 28 is configured for selectably intercommunicating with the atmosphere, through/via an air outlet valve 280. A one-way valve 300 is set in the balance pipe 30 to prevent ink in the carry-in pipe 26 from flowing into the air outlet pipe 28 and yet still permit airflow to the carry-in pipe 26.

A plurality of nozzles 242 extends out of a bottom surface of the print head 24, and at least one ink channel 240 is accommodated in the print head 24 and is in fluid communication with each of the nozzles 242. Each ink channel includes a first ink channel end that is distal to the nozzles 242 and that is in communication with the carry-in pipe 26, to which an external ink supply (e.g., the ink reservoir 22) is connected.

The ink channel 240 includes at least one bending portion 244 and a straight portion 246. In particular there are a pair of bending portions 244, one at each respective end of the straight portion 246. The movement of ink in the straight portion 246 is a kind of advective/horizontal movement. When the ink flows through each bending portion 244, a turbulent movement is produced by the collision of fluid particles. Thus, air bubbles in the ink channel 240 collect in a given bending portion 244. The air bubbles in a given bending portion 244 cannot always come out from the air outlet pipe 28, since the pressure caused by the advective movement is larger than the pressure caused by the turbulent movement.

When the one-way valve 300 is open, one part of the ink supplied by the ink reservoir 22 flows into the ink channel 240, through the carry-in pipe 26, and the other part of the ink flows into the balance pipe 30. Thus, the pressure caused by the advective movement in the straight portion 246 is reduced. Accordingly, if the pressure balance before opening the one-way valve 300 is broken/reduced and the air bubbles can no longer collect in a given bending portion 244, the air bubbles will then come out from the air outlet pipe 28, through the air outlet valve 280. As a result, the air bubbles in print head 24 are eliminated or at least substantially reduced.

The air outlet valve 280 is, advantageously, an air-operated valve or an electromagnetic valve. The air outlet valve 280 in the illustrated embodiment is made of a kind of corrosion resistant material, such as Teflon (PTFE). It is to be understood that any type of ink could potentially be used in the ink-jet device 20.

The ink-jet device 20, as described above, includes the air outlet pipe 28 and the balance pipe 30. The air outlet pipe 28 is configured for eliminating the air bubbles in the straight portion of the carry-in pipe 26 and the ink channel 240. The balance pipe 30 is configured for breaking the pressure balance between the pipes and eliminating the air bubbles amassed/collected in the bending portion 244 of the ink channel 240 or in any other pipes. The ink-jet device 20 can eliminate or at least substantially reduces the air bubbles in the print head 24 without changing the position of the ink reservoir 22 and the print head 24 and/or by supplying a great deal of the ink into the print head 24. The ink-jet device 20 needs less maintenance time and has a high utilization.

Figure 2:
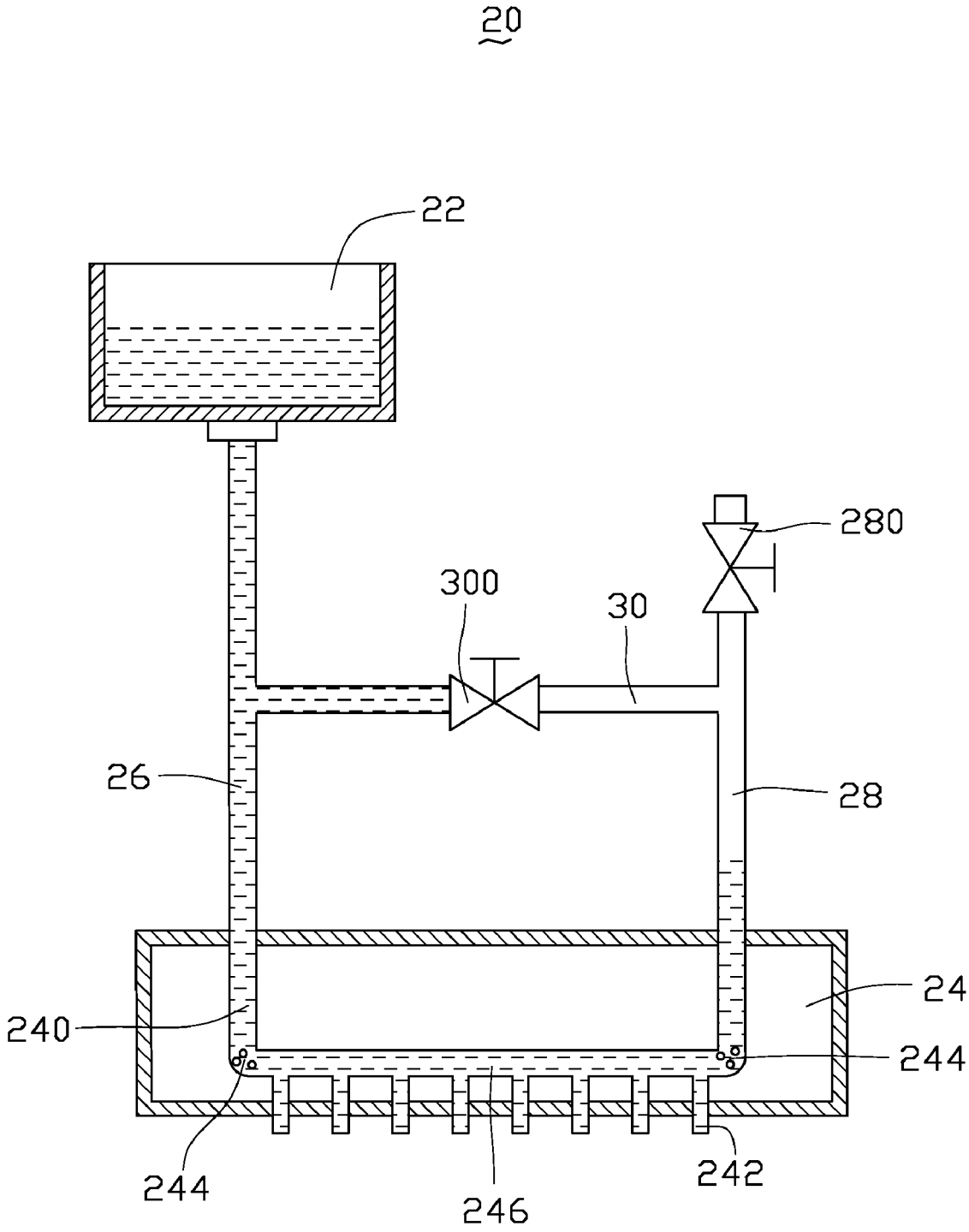
FIGS. 2 to 4 illustrate a method for depositing ink using the ink-jet device, in accordance with the second present embodiment.
Figure 3:
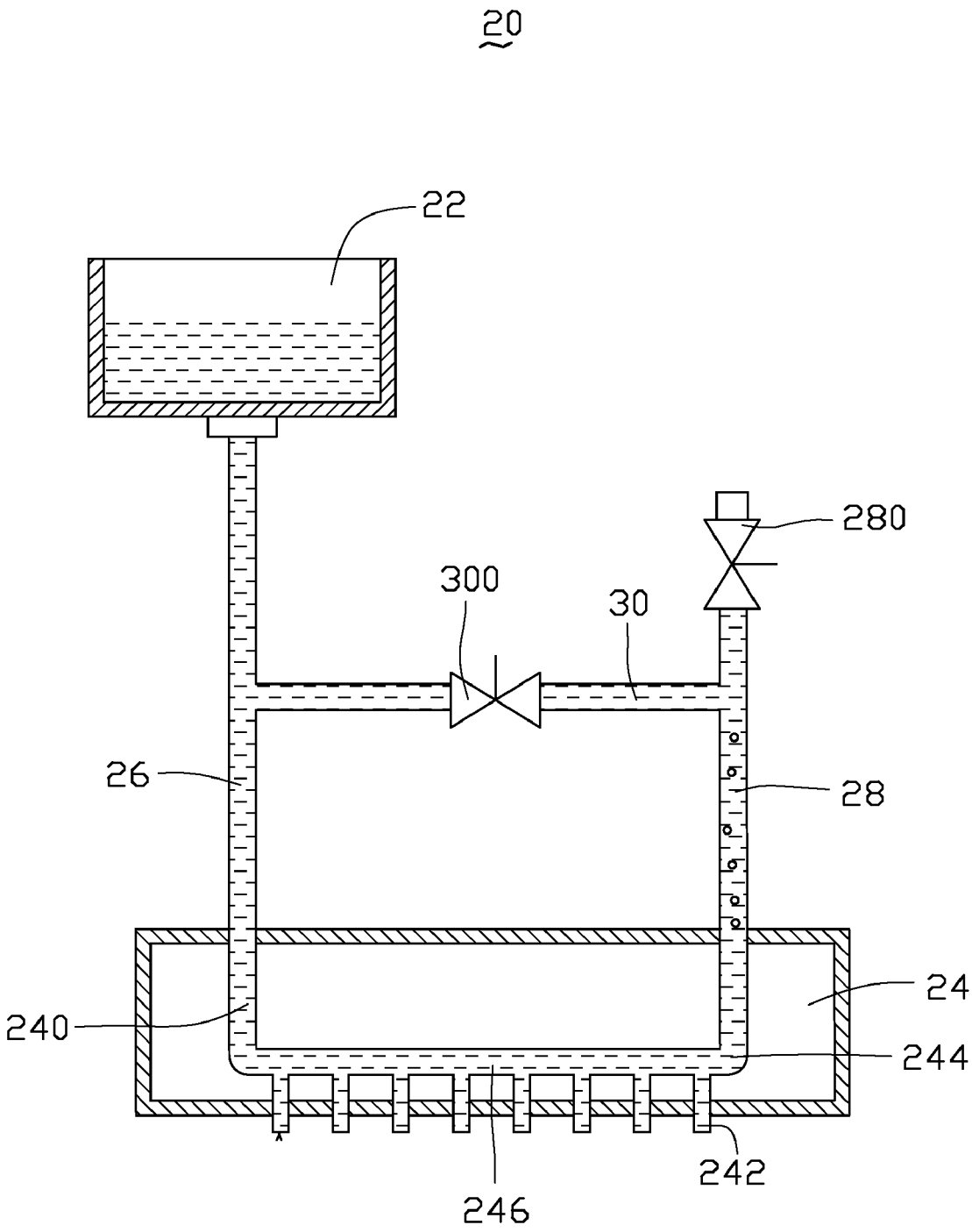
Figure 4:
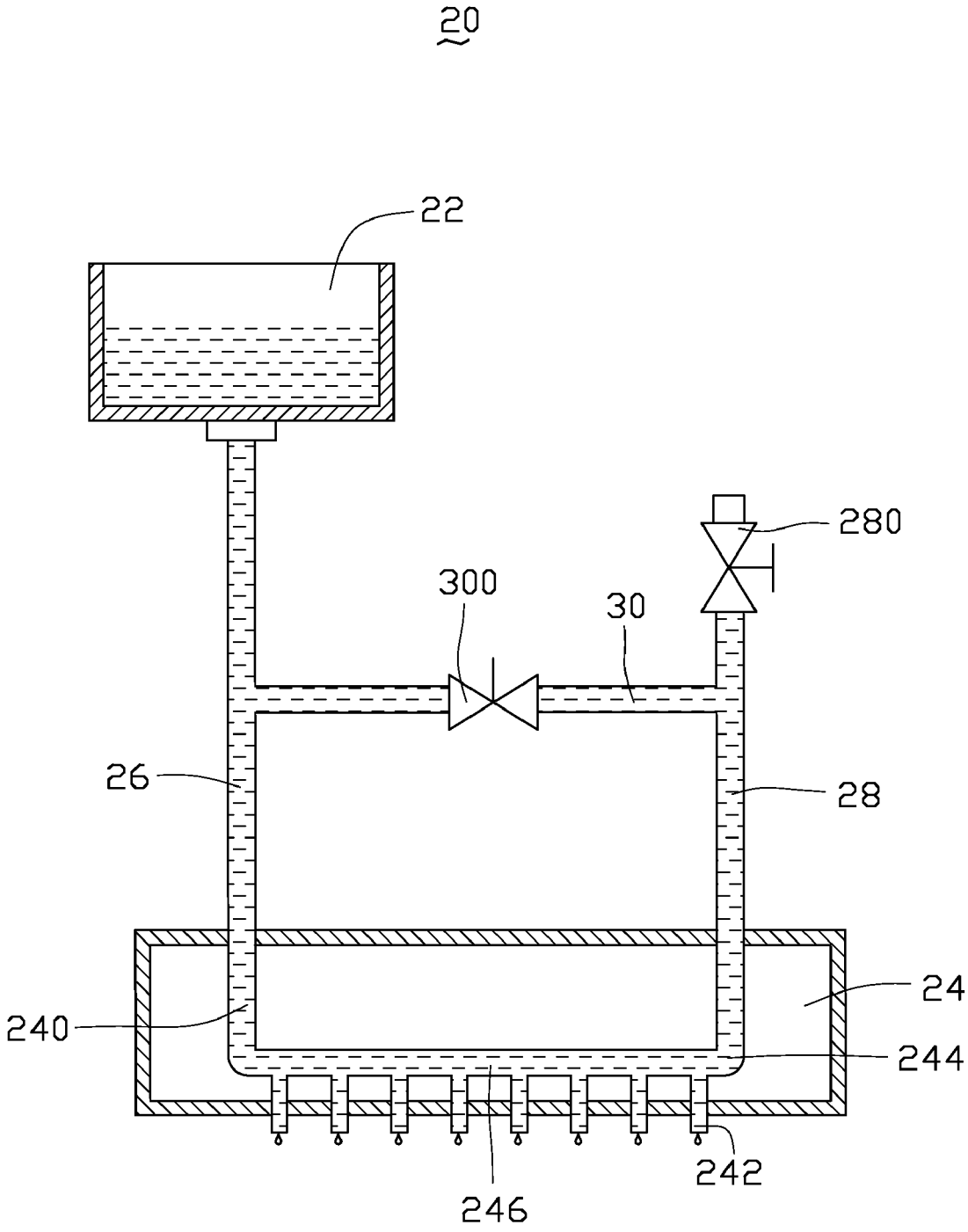
Figure 5:
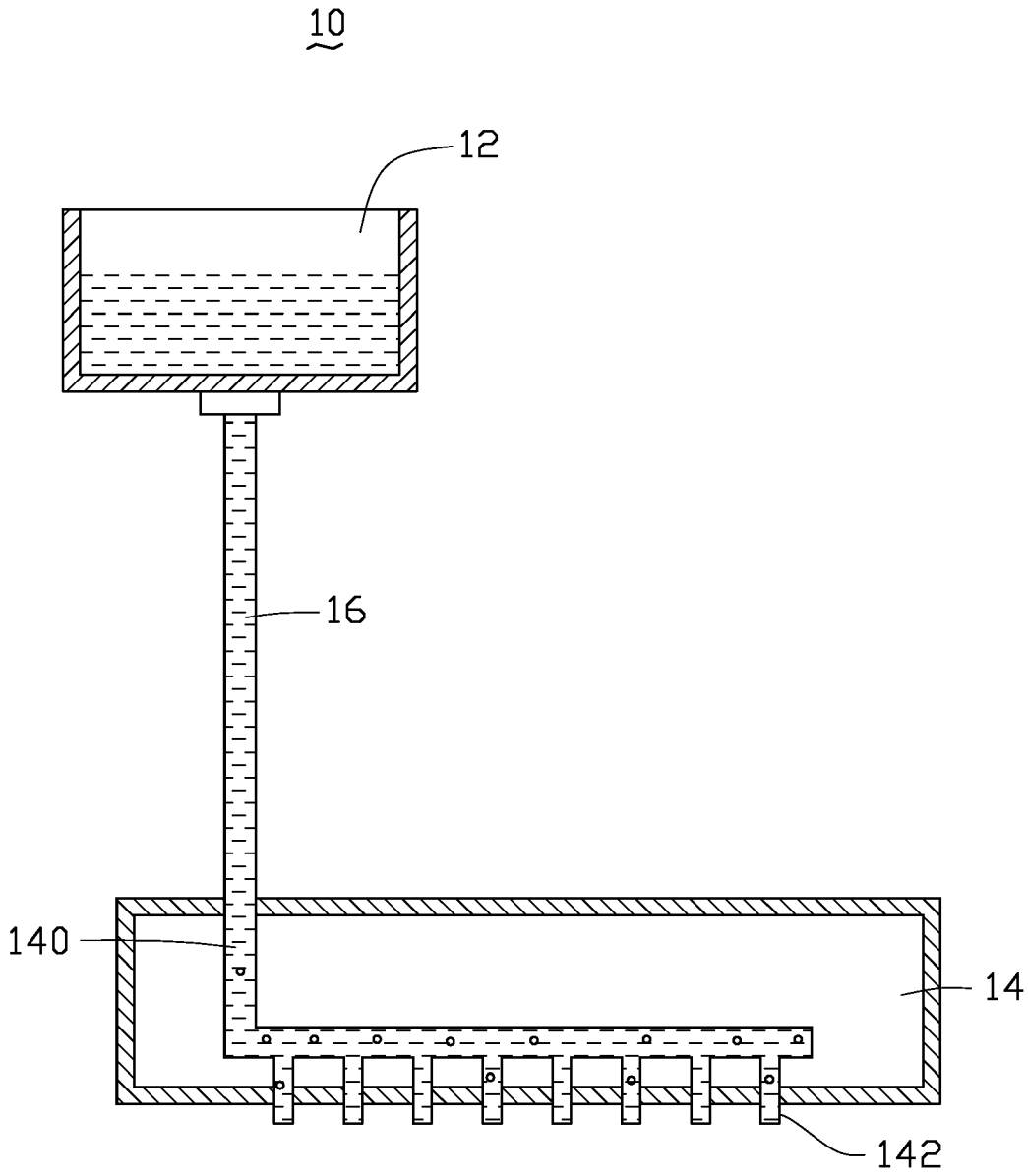
FIG. 5 (RELATED ART)
FIG. 5 is a cross-sectional view of a conventional ink-jet device.

Referring to FIGS. 2 to 4, a process of a method for eliminating the air bubbles in the print head, according to a second present embodiment, is shown.

Firstly, referring to FIG. 2, before the process is started, the ink-jet device, as described above, is provided, the one-way valve 300 and the nozzles 242 are closed, and the air outlet valve 280 is opened. Then, the ink reservoir 22 is forced (i.e., pressure is placed upon the ink therein to cause the ink to flow), and an amount of ink is thereby ejected out from the ink reservoir 22. The ejected ink flows into the ink channel 240 through the carry-in pipe 26. Since the pressure in the air bubbles is smaller than that of the ink, a part of the air bubbles in the straight portion of the carry-in pipe 26, the ink channel 240, and the air outlet pipe 28 come out from the air outlet valve 280. The other part of the air bubbles, caused by the turbulent movement of the ink, tends to get/collect together in the bending portion(s) 244.

Secondly, referring to FIG. 3, the one-way valve 300 is opened to promote an a pressure adjustment in the system. One part of the ink flows into the balance pipe 30. The pressure caused by the advective movement in the straight portion 246 is thereby reduced. Accordingly, the pressure balance before opening the one-way valve is broken/reduced, and the air bubbles no longer collect in a given bending portion 244, but come out of the air outlet pipe 28 through the air outlet valve 280. As a result, most of the air bubbles in the print head 24 are eliminated.

Finally, referring to FIG. 4, the air outlet valve 28 is closed, the nozzles 242 are opened, and thereby the ink is jetted out from the nozzles 242. Accordingly, the air bubbles in the nozzles 242 are finally eliminated.

The method, as described above, uses the air outlet pipe 28 to help eliminate the air bubbles in the carry-in pipe 26 and the ink channel 240 and uses the balance pipe 30 to help eliminate the air bubbles amassed in the respective corners of the bending portions 244. The method can effectively eliminate/remove most, if not all, of the air bubbles in the print head without changing the position of the ink reservoir and the print head and/or by supplying a great deal of the ink into the print head. So, the method is economical and useful.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Furthermore, this application is intended to cover such departures from the present disclosure as come within known or customary practice in the art to which the invention pertains and which fall within the limits of the appended claims or equivalents thereof.

What is claimed is:

1. An ink jet device, used for jetting ink onto a substrate, comprising:
- an ink reservoir;
- a print head positioned lower than the ink reservoir;
- a carry-in pipe connected between the ink reservoir and the print head;
- an air outlet pipe connected with the print head and intercommunicating with the atmosphere;
- an ink channel accommodated within the print head, two ends of the ink channel respectively communicating with the carry-in pipe and the air outlet pipe; and
- a balance pipe fluidly connected between the carry-in pipe and the air outlet pipe and horizontally positioned above the ink channel; the balance pipe is configured for facilitating a pressure balance between the carry-in pipe and the air outlet pipe and eliminating the air bubbles amassed/collected within the ink channel or in any other pipes, thereby the amount of air bubbles in the ink channel or in any other pipes are substantially reduced.

2. The ink jet device as claimed in claim 1, wherein the balance pipe comprises a one-way valve configured for preventing the ink in the carry-in pipe from flowing into the air outlet pipe and yet still permitting airflow to the carry-in pipe.

3. The ink jet device as claimed in claim 1, wherein the air outlet pipe comprises an air outlet valve.

4. The ink jet device as claimed in claim 1, wherein a plurality of nozzles extends out of a bottom surface of the print head.

5. The ink jet device as claimed in claim 1, wherein the ink channel comprises at least one bending portion and a straight portion.

6. The ink-jet device as claimed in claim 1, wherein the air outlet valve is an air-operated valve or an electromagnetic valve.

7. The ink-jet device as claimed in claim 1, wherein the air outlet valve is made of PTFE.

8. A method for depositing ink using an ink-jet device, the ink-jet device having a print head, the method being performed in a manner so as to promote elimination of air bubbles in the print head, the method comprising the steps of:
- providing an ink jet device, comprising:
  - an ink reservoir;
  - a print head with a plurality of nozzles extending out thereof;
  - a carry-in pipe connected between the ink reservoir and the print head;
  - an air outlet pipe connected with the print head and intercommunicating with the atmosphere, the air outlet pipe comprising an air outlet valve; and
  - a balance pipe connected between the carry-in pipe and the air outlet pipe, the balance pipe comprising a one-way valve configured for preventing the ink in the carry-in pipe from flowing into the air outlet pipe;

closing the one-way valve and the nozzles, and opening the air outlet valve;

forcing the ink reservoir to eject an amount of the ink out therefrom so as to form a pressure balance between the carry-in pipe and the air outlet pipe;

opening the one-way valve to break/reduce the pressure balance before opening the one-way valve; and closing the air-outlet valve and opening the nozzles to force the ink to be jetted out from the nozzles.

* * * * *